US011253038B2

(12) United States Patent
Liu et al.

(10) Patent No.: US 11,253,038 B2
(45) Date of Patent: Feb. 22, 2022

(54) HAIR DRYER

(71) Applicants: SHENZHEN AIRGLE CORPORATION LIMITED, Shenzhen (CN); AIRGLE CORPORATION, Holbrook, NY (US)

(72) Inventors: Xin Liu, Shenzhen (CN); Zheng Liu, Shenzhen (CN); Yong Xu, Shenzhen (CN); Guanjun Long, Shenzhen (CN); Lieqing Nie, Shenzhen (CN); Shaoqi Shi, Shenzhen (CN)

(73) Assignees: SHENZHEN AIRGLE CORPORATION LIMITED, Shenzhen (CN); AIRGLE CORPORATION, Holbrook, NY (US)

( * ) Notice: Subject to any disclaimer, the term of this patent is extended or adjusted under 35 U.S.C. 154(b) by 28 days.

(21) Appl. No.: 16/836,958

(22) Filed: Apr. 1, 2020

(65) Prior Publication Data

US 2021/0282522 A1 Sep. 16, 2021

(30) Foreign Application Priority Data

Mar. 12, 2020 (CN) ..... 202010174693.1
Mar. 12, 2020 (CN) ..... 202020310430.4

(51) Int. Cl.
*A45D 20/12* (2006.01)

(52) U.S. Cl.
CPC ..... *A45D 20/12* (2013.01)

(58) Field of Classification Search
CPC ..... A45D 20/12; A45D 20/00; F04D 29/00; F04D 29/688
USPC ..... 34/95–100
See application file for complete search history.

(56) References Cited

U.S. PATENT DOCUMENTS

| | | | | |
|---|---|---|---|---|
| 4,751,485 | A | 6/1988 | Fujio et al. | |
| 4,896,021 | A * | 1/1990 | Poweleit | A45D 20/12 34/97 |
| 7,047,660 | B2 * | 5/2006 | Leventhal | A45D 20/122 34/97 |
| 8,387,271 | B2 * | 3/2013 | Shami | A61N 5/0617 34/283 |
| 8,922,082 | B2 * | 12/2014 | Kwon | F04D 25/0606 310/90 |
| 9,692,189 | B2 * | 6/2017 | Lin | H01R 13/521 |
| 10,021,951 | B2 * | 7/2018 | Bobillier | A45D 20/12 |
| 10,080,414 | B2 * | 9/2018 | Douglas | F16M 13/02 |

(Continued)

FOREIGN PATENT DOCUMENTS

| | | | |
|---|---|---|---|
| CN | 209788885 U | | 12/2019 |
| CN | 111184333 A | * | 5/2020 |
| CN | 111972806 A | | 11/2020 |
| CN | 211932981 U | * | 11/2020 |
| JP | S6137205 A | | 2/1986 |

(Continued)

OTHER PUBLICATIONS

First Office Action in counterpart Korean Application No. 10-2020-0039451 dated Jul. 20, 2021.

(Continued)

*Primary Examiner* — Stephen M Gravini

(57) ABSTRACT

The present disclosure provides a hair dryer, including: a housing provided with a main control board; a power line connected to the housing and extending out of the housing; and a conductive metal sheet fixed to an inner wall of the housing, and configured to electrically conduct the main control board with the power line.

10 Claims, 7 Drawing Sheets

(56) References Cited

U.S. PATENT DOCUMENTS

| | | | | |
|---|---|---|---|---|
| 10,299,560 | B1 * | 5/2019 | Nelson | H01M 50/10 |
| 2015/0157106 | A1 | 6/2015 | Atkinson | |
| 2016/0166036 | A1 * | 6/2016 | Li | A45D 20/12 34/97 |
| 2018/0055184 | A1 | 3/2018 | McVeigh et al. | |

FOREIGN PATENT DOCUMENTS

| | | | |
|---|---|---|---|
| JP | S6269415 | A | 3/1987 |
| JP | S6465738 | A | 3/1989 |
| JP | H077471 | A | 1/1995 |
| JP | H08228820 | A | 9/1996 |
| JP | 2015066447 | A | 4/2015 |
| JP | 2015112493 | A | 6/2015 |
| JP | 2016526429 | A | 9/2016 |
| JP | 2016531626 | A | 10/2016 |
| JP | 2017070334 | A | 4/2017 |
| KR | 20100080727 | A | 7/2010 |
| KR | 20130060391 | A | 6/2013 |
| KR | 20180086531 | A | 7/2018 |

OTHER PUBLICATIONS

First Office Action in counterpart British Application No. GB2101208.3 dated Jun. 28, 2021.
The partial European search report in counterpart European Application No. EP21154015 dated Jul. 6, 2021.
Notice of Reasons for Refusal in counterpart Japanese Application No. 2020-058739 dated Oct. 6, 2021.

* cited by examiner

HAIR DRYER

CROSS REFERENCE TO RELATED APPLICATIONS

The present disclosure claims the priorities of Chinese Patent Application Nos. 202020310430.4 and 202010174693.1, both filed on Mar. 12, 2020, the entire disclosure of which is hereby incorporated by reference, in its entirety, for all that it teaches and for all purposes.

TECHNICAL FIELD

The present disclosure relates to the technical field of household appliances, and in particular, to a hair dryer.

BACKGROUND

In related arts, multiple cables are usually provided inside the hair dryer to electrically connect the components. Because of the limitation of the shapes and sizes of the cables, it is not possible to effectively reduce the volume of the handle. Meanwhile, the setting of multiple cables is not conducive for the user to assemble and disassemble the hair dryer, which reduces the usability of the hair dryer.

The above contents are only used to assist in understanding the technical solution of the present disclosure, which do not mean that the above contents are prior arts.

SUMMARY

The main objective of the present disclosure is to provide a hair dryer, which aims to effectively reduce the volume of the hair dryer, so as to facilitate the user to hold it, and improve the operation during the installation and maintenance of the hair dryer, thereby improving the usability of the hair dryer.

In order to achieve the above objective, the present disclosure provides a hair dryer, including:

a housing provided with a main control board;

a power line connected to the housing and extending out of the housing; and a conductive metal sheet fixed to an inner wall of the housing, and configured to electrically conduct the main control board with the power line.

In an embodiment of the present disclosure, the power line includes a live wire terminal and a neutral wire terminal; and the hair dryer includes: a first conductive metal sheet connected to the live wire terminal; and a second conductive metal sheet connected to the neutral wire terminal, the first conductive metal sheet and the second conductive metal sheet being symmetrically disposed on the inner wall of the housing.

In an embodiment of the present disclosure, the conductive metal sheet is integrated with the inner wall of the housing; and/or the conductive metal sheet is a copper sheet.

In an embodiment of the present disclosure, an anti-oxidation layer is formed on a portion of the conductive metal sheet exposed outside the inner wall of the housing.

In an embodiment of the present disclosure, the housing includes a body and a handle connected to the body; the conductive metal sheet is disposed on an inner wall of the handle; the main control board is disposed in the body; and the power line is connected to an end of the handle away from the body.

In an embodiment of the present disclosure, the hair dryer further includes an operation switch slidably disposed on the handle and located between the body and the conductive metal sheet, the operation switch being configured to make the main control board and the conductive metal sheet in a conducting state or a non-conducting state by sliding.

In an embodiment of the present disclosure, the handle includes an air inlet; the body includes an air outlet; and the hair dryer further includes a fan located in the handle and electrically connected to the main control board, the fan being configured to suck an external air fluid from the air inlet.

In an embodiment of the present disclosure, the hair dryer further includes: a first filter sleeve sleeved and fixed on the handle, and configured to cover the air inlet, the first filter sleeve including first filter holes for filtering the external air fluid.

In an embodiment of the present disclosure, an end of the handle away from the body is protruded with abutting protrusions, the abutting protrusions being configured to limit the first filter sleeve when the first filter sleeve is sleeved on the handle; and/or the hair dryer further includes a second filter sleeve connected to the end of the handle away from the body, an inner surface of the second filter sleeve being abutted against an outer surface of the first filter sleeve, the second filter sleeve including second filter holes oppositely disposed to the first filter holes, and a pore diameter of one of the first filter holes is smaller than a pore diameter of one of the second filter holes.

The present disclosure further provides a hair dryer, including:

a housing including a body and a handle, the body being provided with a main control board;

a power line connected to the handle and extending out of the handle;

a conductive metal sheet fixed to an inner wall of the handle, and configured to electrically conduct the main control board and the power line; and a fan disposed in the handle and electrically connected to the main control board, and a central axis of the fan coinciding with a central axis of the handle in an extending direction of the handle.

In the technical solution of the present disclosure, the hair dryer includes a housing provided with a main control board; a power line connected to the housing and extending out of the housing; and a conductive metal sheet fixed to an inner wall of the housing, and configured to electrically conduct the main control board and the power line. As such, the conductive metal sheet is used to replace multiple cables to achieve electrical continuity, thereby saving the wiring space in the housing of the hair dryer, which can correspondingly reduce the size of the hair dryer and improve the user's feeling of holding the hair dryer. When the hair dryer is disassembled for maintenance, the conductive metal sheet does not easily affect the maintenance operation of the user. Meanwhile, since the conductive metal sheet is fixed to the inner wall of the housing, the conductive metal sheet is not easy to shake when using the hair dryer, thereby improving the usability of the hair dryer.

BRIEF DESCRIPTION OF THE DRAWINGS

In order to more clearly illustrate the embodiments of the present disclosure or the technical solutions in the related art, the drawings used in the embodiments or the related art will be briefly described below. Obviously, the drawings in the following description are only some embodiments of the present disclosure. It will be apparent to those skilled in the art that other figures can be obtained from the structures illustrated in the drawings without the inventive effort.

DESCRIPTION OF REFERENCE NUMERALS

Figure 1:
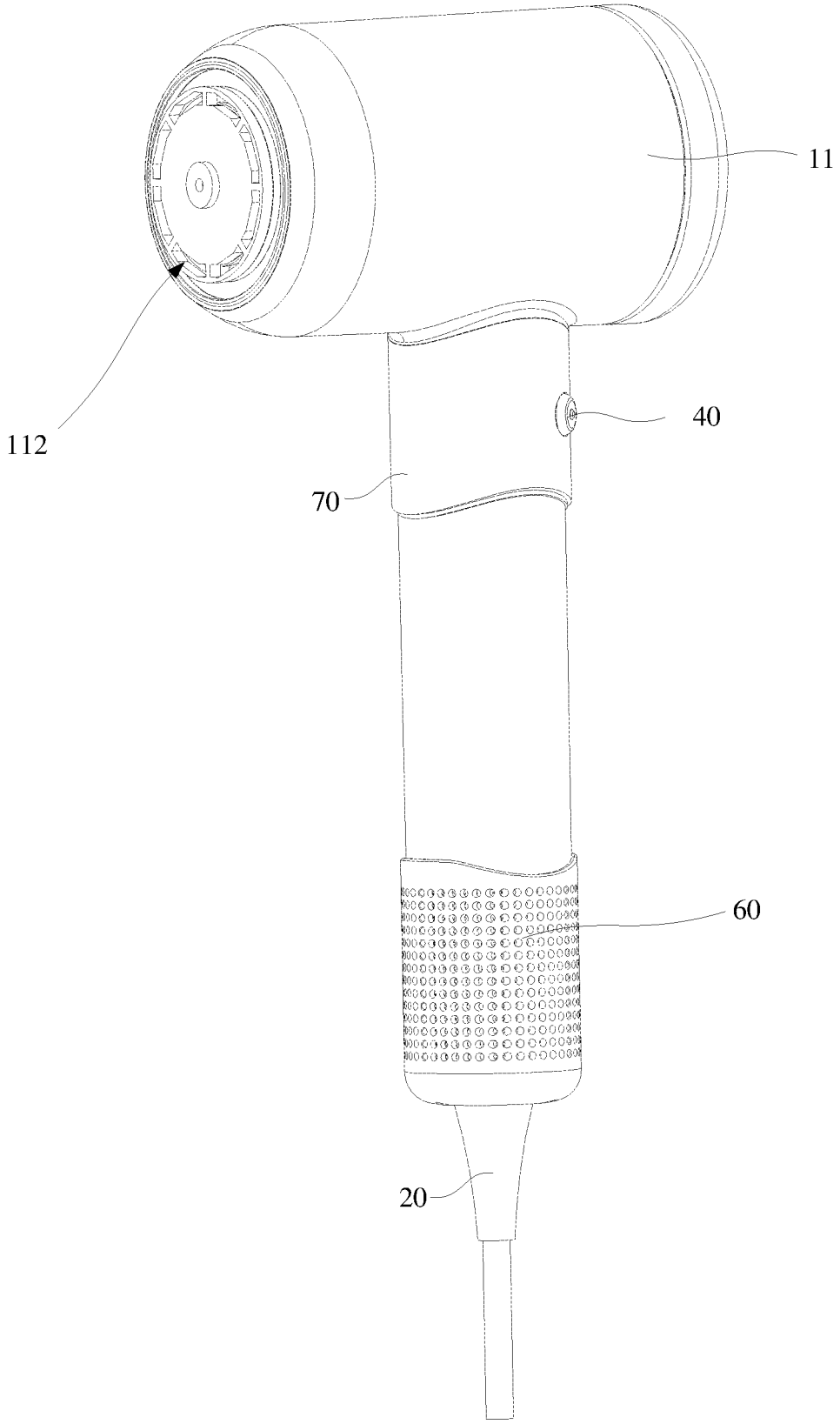
FIG. 1 is a schematic structural diagram of a hair dryer according to an embodiment of the present disclosure.

| Label | Name |
|---|---|
| 100 | Hair dryer |
| 10 | Housing |
| 11 | Body |
| 112 | Air outlet |
| 12 | Handle |
| 121 | Air inlet |
| 122 | Abutting protrusion |
| 123 | Arc-shaped housing |
| 20 | Power line |
| 30 | Conductive metal sheet |
| 40 | Operation switch |
| 50 | First filter sleeve |
| 51 | First filter hole |
| 60 | Second filter sleeve |
| 61 | Second filter hole |
| 70 | Casing |

The realization of the objective, functional characteristics, advantages of the present disclosure are further described with reference to the accompanying drawings.

DETAILED DESCRIPTION OF THE EMBODIMENTS

The technical solutions of the embodiments of the present disclosure will be clearly and completely described in the following with reference to the accompanying drawings. It is obvious that the embodiments to be described are only a part rather than all of the embodiments of the present disclosure. All other embodiments obtained by persons skilled in the art based on the embodiments of the present disclosure without creative efforts shall fall within the protection scope of the present disclosure.

It is to be understood that, all of the directional instructions in the embodiments of the present disclosure (such as up, down, left, right, front, rear . . . ) can only be used for explaining relative position relations, moving condition of the elements under a special form (referring to figures), and so on, if the special form changes, the directional instructions changes accordingly.

In the present disclosure, unless specified or limited otherwise, the terms "connected", "fixed" and the like are used broadly. For example, "fixed" can be fixed connections, detachable connections, or integral connections; may also be mechanical or electrical connections; may also be direct connections or indirect connections via intervening structures, may also be inner connecting of two elements, or interaction relationship between two elements. For those skilled in the art, the specific meanings of the above terms in the present disclosure can be understood according to specific situations.

In addition, the descriptions, such as the "first", the "second" in the embodiment of present disclosure, can only be used for describing the aim of description, and cannot be understood as indicating or suggesting relative importance or impliedly indicating the number of the indicated technical feature. Therefore, the feature indicated by the "first", the "second" can express or impliedly include at least one feature. In addition, the meaning of "and/or" appearing throughout the text is that it includes three paratactic schemes, taking "A and/or B" as examples, including scheme A, or scheme B, or schemes that A and B meet at the same time. Besides, the technical solution of each embodiment can be combined with each other, however the technical solution must base on that the ordinary skill in that art can realize the technical solution, when the combination of the technical solutions is contradictory or cannot be realized, it should consider that the combination of the technical solutions does not exist, and is beyond the protection scope of the present disclosure.

The present disclosure provides a hair dryer 100.

Referring to FIG. 1 to FIG. 4, in the embodiment of the present disclosure, the hair dryer 100 includes a housing 10 provided with a main control board (not shown); a power line 20 connected to the housing 10 and extending out of the housing 10; and a conductive metal sheet 30 fixed to an inner wall of the housing 10, and configured to electrically conduct the main control board and the power line 20.

The main control board may be a printed circuit board (PCB), such that the electrical components in the hair dryer 100 can be electrically controlled through the PCB. The conductive metal sheet 30 may be connected to the PCB at one end and connected to the power line 20 at the other end, so as to electrically connect the PCB and the power line 20. However, when the PCB is installed at a distance from the conductive metal sheet 30, a shorter wire can also be provided to electrically connect the PCB and the conductive metal sheet 30. Due to the flexibility of the wires, the wire can be deformably disposed in the housing 10, thereby adapting to the situation that the PCB and the conductive metal sheet 30 are far away. The conductive metal sheet 30 may be arranged in a C shape, that is, two ends of the conductive metal sheet 30 are formed with protrusions away from the surface of the housing 10. As such, through the protrusions at both ends, the power line 20 and the main control board can be more easily connected with the conductive metal sheet 30, and the protrusions can also play a role in facilitating the installation and positioning of the conductive metal sheet 30. Besides, in order to improve the safety of using the hair dryer 100, the material of the housing 10 can be made of plastic materials, such as ABS, POM, PS, PMMA, PC, PET and other materials, of course, it can also be other insulation materials. Therefore, when the hair dryer 100 leaks electricity, it is difficult for the user to hold the handle 12 to get an electric shock, which improves the safety of the user when using the hair dryer 100. It should be noted that the conductive metal sheet 30 is fixed to the inner wall of the housing 10. The conductive metal sheet 30 may be attached to the inner wall of the housing 10 to facilitate installation. Alternatively, a part of the conductive metal sheet 30 may be buried in the inner wall of the housing 10, and then both ends of the conductive metal sheet may protrude from the inner wall of the housing, and then be electrically connected to the main control board and the power line 20. Thereby, the stability of fixing the conductive metal sheet 30 can be ensured, which can be specifically performed by those skilled in the art.

In the technical solution of the present disclosure, the hair dryer 100 includes a housing 10 provided with a main control board; a power line 20 connected to the housing 10 and extending out of the housing 10; and a conductive metal sheet 30 fixed to an inner wall of the housing 10, and configured to electrically conduct the main control board and the power line 20. As such, the conductive metal sheet 30 is used to replace multiple cables to achieve electrical continuity, thereby saving the wiring space in the housing 10 of the hair dryer 100, which can correspondingly reduce the size of the hair dryer 100 and improve the user's feeling of holding the hair dryer 100. When the hair dryer 100 is disassembled for maintenance, the conductive metal sheet 30 does not easily affect the maintenance operation of the user. Meanwhile, since the conductive metal sheet 30 is fixed to the inner wall of the housing 10, the conductive metal sheet 30 is not easy to shake when using the hair dryer 100, thereby improving the usability of the hair dryer 100.

In an embodiment of the present disclosure, referring to FIG. 2 to FIG. 5, the power line 20 includes a live wire terminal and a neutral wire terminal. The hair dryer 100 includes a first conductive metal sheet 30 and a second conductive metal sheet 30. The first conductive metal sheet 30 is connected to the live wire terminal, and the second conductive metal sheet 30 is connected to the neutral wire terminal. The first conductive metal sheet 30 and the second conductive metal sheet 30 are symmetrically disposed on the inner wall of the housing 10. Specially, in order to further improve the safety of using the hair dryer 100, two conductive metal sheets 30 are respectively connected to the live wire terminal and the neutral wire terminal of the power line 20, thereby the two conductive metal sheets 30 cooperate to make the main control board and the power supply line 20 completely conductive. In addition, the overall electrical circuit setting of the hair dryer 100 is relatively safe and reasonable, which further improves the use safety of the hair dryer 100. In order to further rationalize the internal structure of the housing 10, two conductive metal sheets 30 may be symmetrically disposed on the inner wall of the housing 10, such that the entire force of the housing 10 is balanced and the internal space of the housing 10 is arranged more compactly and reasonably. In addition, there is a certain distance between the two conductive metal sheets 30 that are respectively connected to the live wire terminal and the neutral wire terminal of the power line 20 to avoid the danger that the two conductive metal sheets 30 are too close to each other, thereby improving the use safety of the hair dryer 100.

Figure 2:
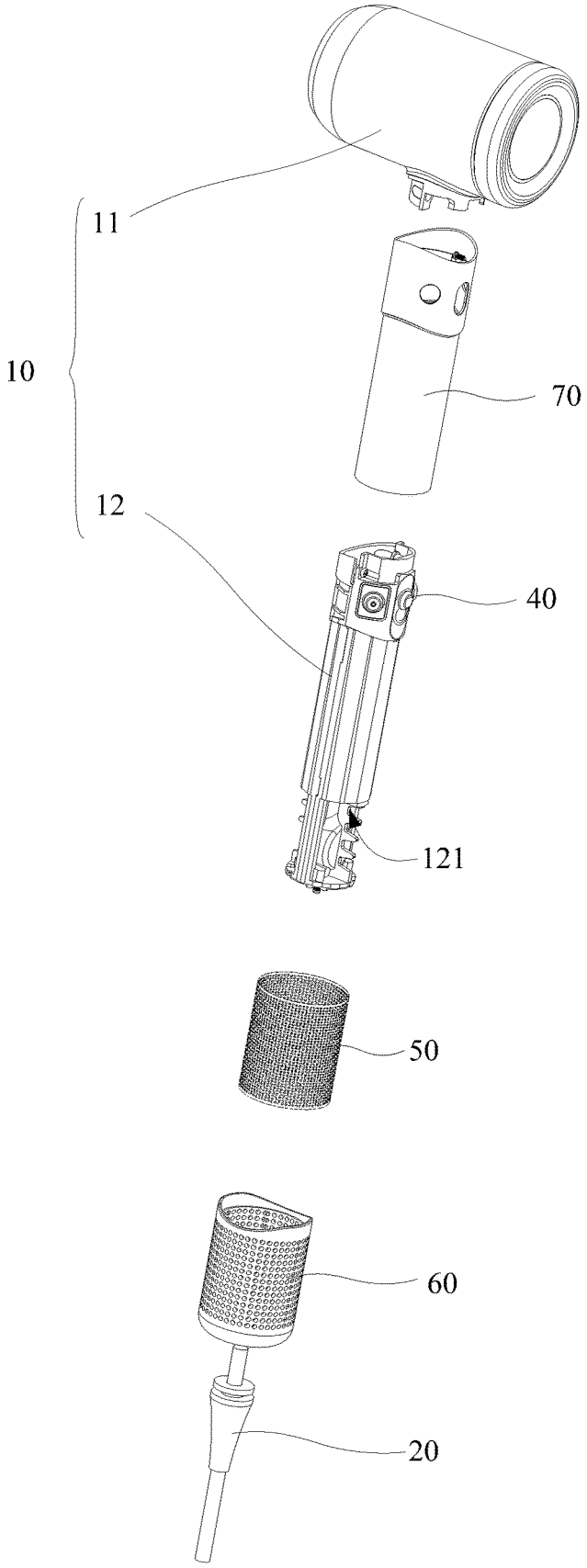
FIG. 2 is an exploded schematic structural diagram of the hair dryer according to the present disclosure.
Figure 3:
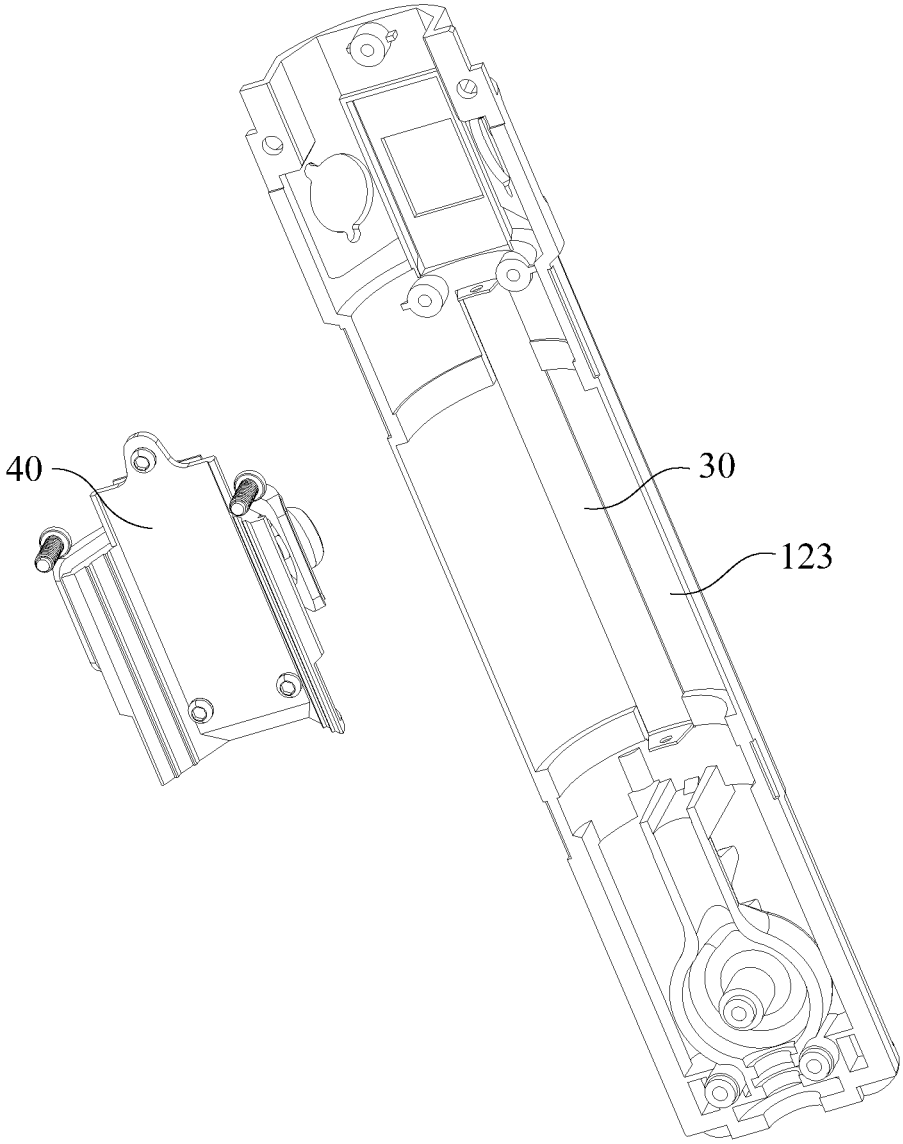
FIG. 3 is a schematic structural diagram of an installation of a part of the hair dryer according to the present disclosure.
Figure 4:
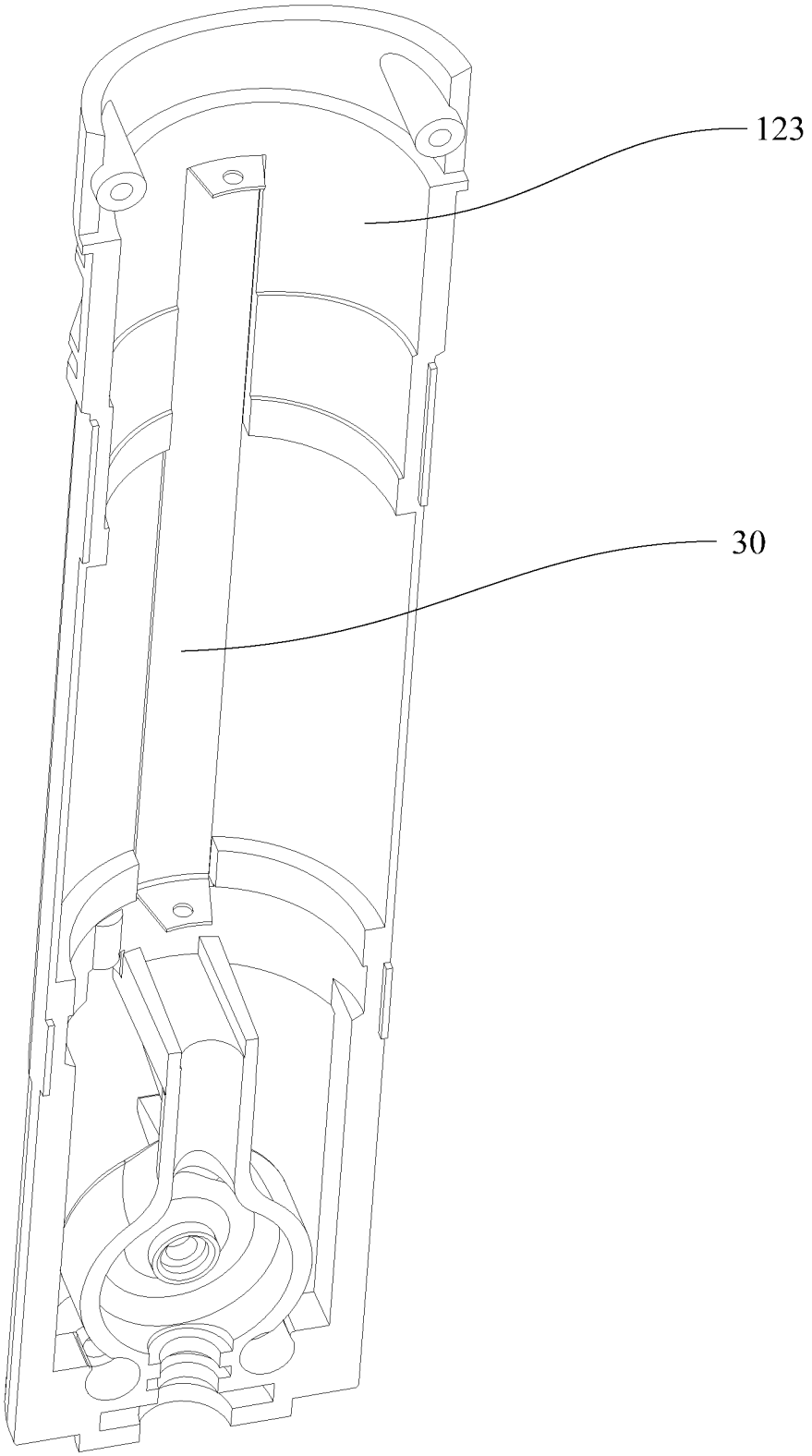
FIG. 4 is a schematic structural diagram of an installation of the conductive metal sheet and the housing of the hair dryer according to the present disclosure.

In an embodiment of the present disclosure, referring to FIG. 2 to FIG. 4, the conductive metal sheet 30 is integrated with the inner wall of the handle 12. The housing 10 may be formed by injection molding, and the conductive metal sheet 30 may be placed in a processing mold in advance, such that the housing 10 and the conductive metal sheet 30 are integrally formed by injection molding. Not only the installation process of the conductive metal sheet 30 is omitted, but also the stability of the connection between the conductive metal sheet 30 and the housing 10 is ensured, so that the conductive metal sheet 30 cannot easily fall off, and the electrical connection between the main control board and the power line 20 is ensured.

In some embodiments, the conductive metal sheet is a copper sheet. Specially, since copper has good conductivity, the conductive metal sheet 30 may be a copper sheet, thereby ensuring the electrical connection between the main control board and the power line 20 of the hair dryer 100. It should be noted that the conductive metal sheet 30 may also be an aluminum sheet or an iron sheet, which may be specifically selected by those skilled in the art, and will not be described here.

In an embodiment of the present disclosure, an anti-oxidation layer is formed on a portion of the conductive metal sheet 30 exposed outside the inner wall surface of the housing 10. Since the conductive metal sheet 30 is exposed outside for a long time, it is prone to oxidation, resulting in a decrease in conductive performance. Therefore, the anti-oxidation layer is formed on a portion of the conductive metal sheet 30 exposed outside the inner wall surface of the housing 10, which not only effectively prevents the oxidation of the conductive metal sheet 30, but also increases the conductivity. The anti-oxidation layer may be a nickel-plated layer or the like, and can be specifically selected by those skilled in the art, and will not be described here.

Figure 5:
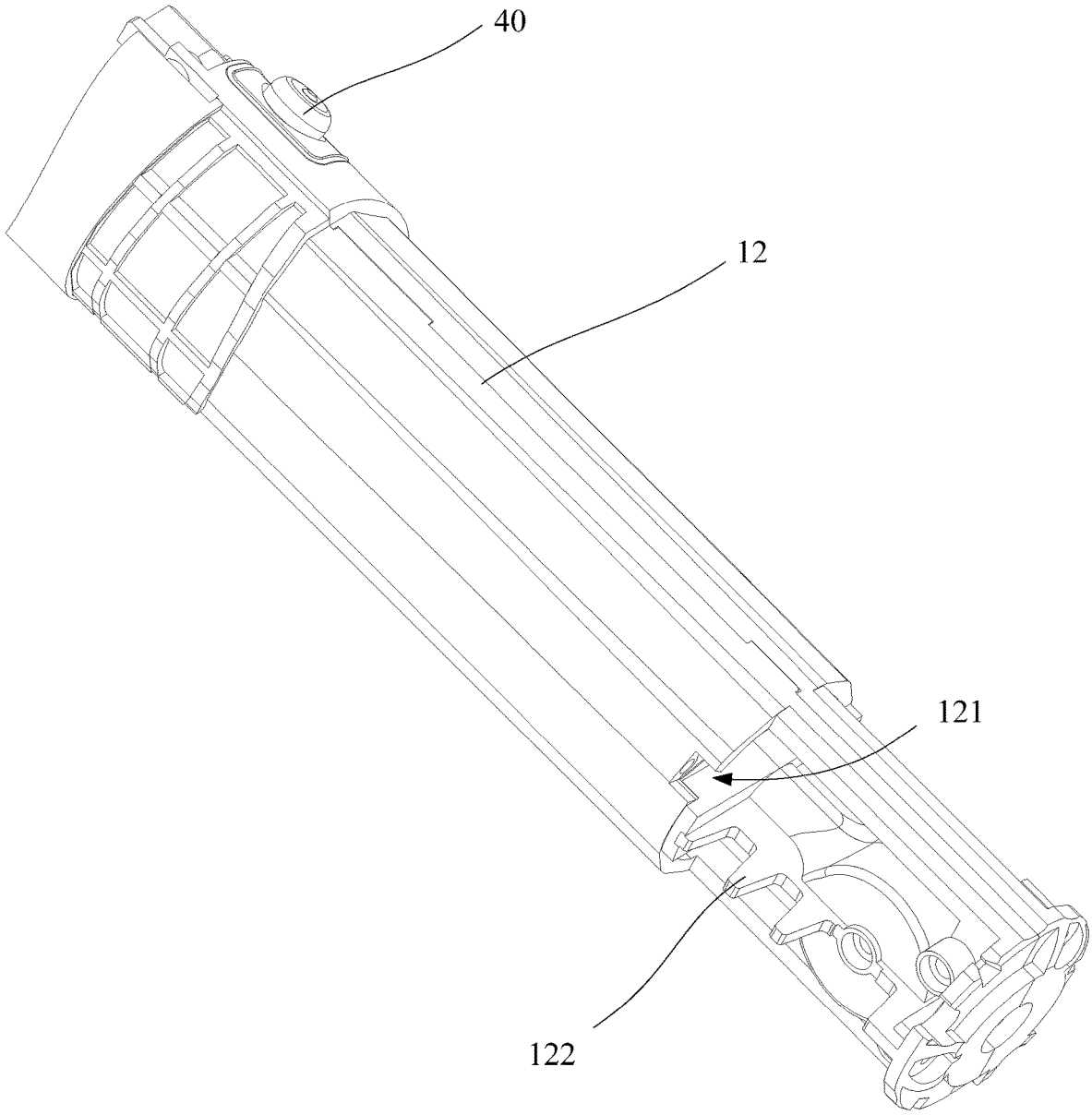
FIG. 5 is a schematic structural diagram of an assembly of a handle and an operation switch of the hair dryer according to the present disclosure.

In an embodiment of the present disclosure, referring to FIG. 1, FIG. 2 and FIG. 5, the housing 10 includes a body 11 and a handle 12 connected to the body 11. The conductive metal sheet 30 is disposed on an inner wall of the handle 12. The main control board is disposed in the body 11, and the power line 20 is connected to an end of the handle 12 away from the body 11. The body 11 may be provided with a heating structure such as a heating wire. In this way, the main control board may control the heating wire, so that the fluid flowing in from the air inlet 121 is heated by the heating wire and discharged from the air outlet 112 to meet the situation when the user needs hot air. The handle 12 may be formed by connecting two symmetrically-arranged arc-shaped housings 123, and the handle 12 is formed into a cylindrical shape through the connection and cooperation of the two arc-shaped housings 123, which is more convenient for users to hold. In order to facilitate the installation, the two arc-shaped housings 123 and the housing 10 can be fixed by a snap connection, and can also be connected by screw connection, etc. For the rationality of the setting, the conductive metal sheet 30 may be provided on each of the two arc-shaped housings 123, so that the live wire terminal and the neutral wire terminal of the power line 20 may be connected, and it is also convenient to perform separate maintenance for each conductive metal sheet 30 in the later stage. In order to further increase the service life of the handle 12, the hair dryer 100 further includes a casing 70, which is sleeved on the outer surface of the handle 12. The casing 70 can effectively wrap and protect the handle 12, and can also improve the user's grip. In addition, in order to increase the functionality of the hair dryer 100, a negative ion structure may be provided in the handle 12 to process the fluid sucked by the fan, so that the fluid discharged from the air outlet 112 is more clean and meets the needs of users.

In an embodiment of the present disclosure, the hair dryer 100 further includes an operation switch 40 slidably disposed on the handle 12 and located between the body 11 and the conductive metal sheet 30. The operation switch 40 is configured to make the main control board and the conductive metal sheet 30 in a conducting state or a non-conducting state by sliding. The operation switch 40 is slidably disposed in the handle 12. Both ends of the operation switch 40 are connected ends. The two connecting ends are movable relative to the handle 12. One connection end is always connected with the body 11, while the other connection end is disconnected with the conductive metal sheet 30. When the user wants to use the hair dryer 100, the connection end of the operation switch 40 away from the body 11 is brought into contact with the conductive metal sheet 30 through sliding the operation switch 40. Thereby, the operation switch 40 is electrically connected to the conductive metal sheet 30, and the body 11 is connected with the conductive metal sheet 30, so as to achieve the normal operation of the hair dryer 100. When the operation switch 40 slides to the initial position, the operation switch 40 is separated from the conductive metal sheet 30 at this time, so that the body 11 and the conductive metal sheet 30 are disconnected to stop the work of the hair dryer 100. In this way, the user can control the opening and closing of the hair dryer 100 by sliding the operation switch 40, which is more convenient. It should be noted that the operation switch 40 is always abutted against the conductive metal sheet 30. By sliding the operation switch 40 to abut and disengage the operation switch 40 from the body 11, the body 11 may be connected and disconnected with the conductive metal sheet 30. It should be noted that the operation switch 40 is also connected to the main control board, so that the operation switch 40 can also adjust the wind speed and temperature, which can be selected according to those skilled in the art, and will not be described here.

Referring to FIG. 1, FIG. 2 and FIG. 5, in an embodiment of the present disclosure, the hair dryer 100 further includes a fan (not shown) located in the handle 12 and electrically connected to the main control board. The handle 12 includes an air inlet 121, the body 11 includes an air outlet 112, and the fan is configured to suck an external air fluid from the air inlet 121. Specially, by placing the fan in the handle 12 so as to approach the air inlet 121, the external air fluid can be sucked from the air inlet 121 more effectively. The fan can be specifically driven by a motor to drive the blades for rotary suction, and the fan is located at the handle 12 to effectively reduce the weight of the body 11. When the user holds the handle 12, the hair dryer 100 as a whole is more stable, which facilitates the use of the hair dryer 100.

Figure 6:
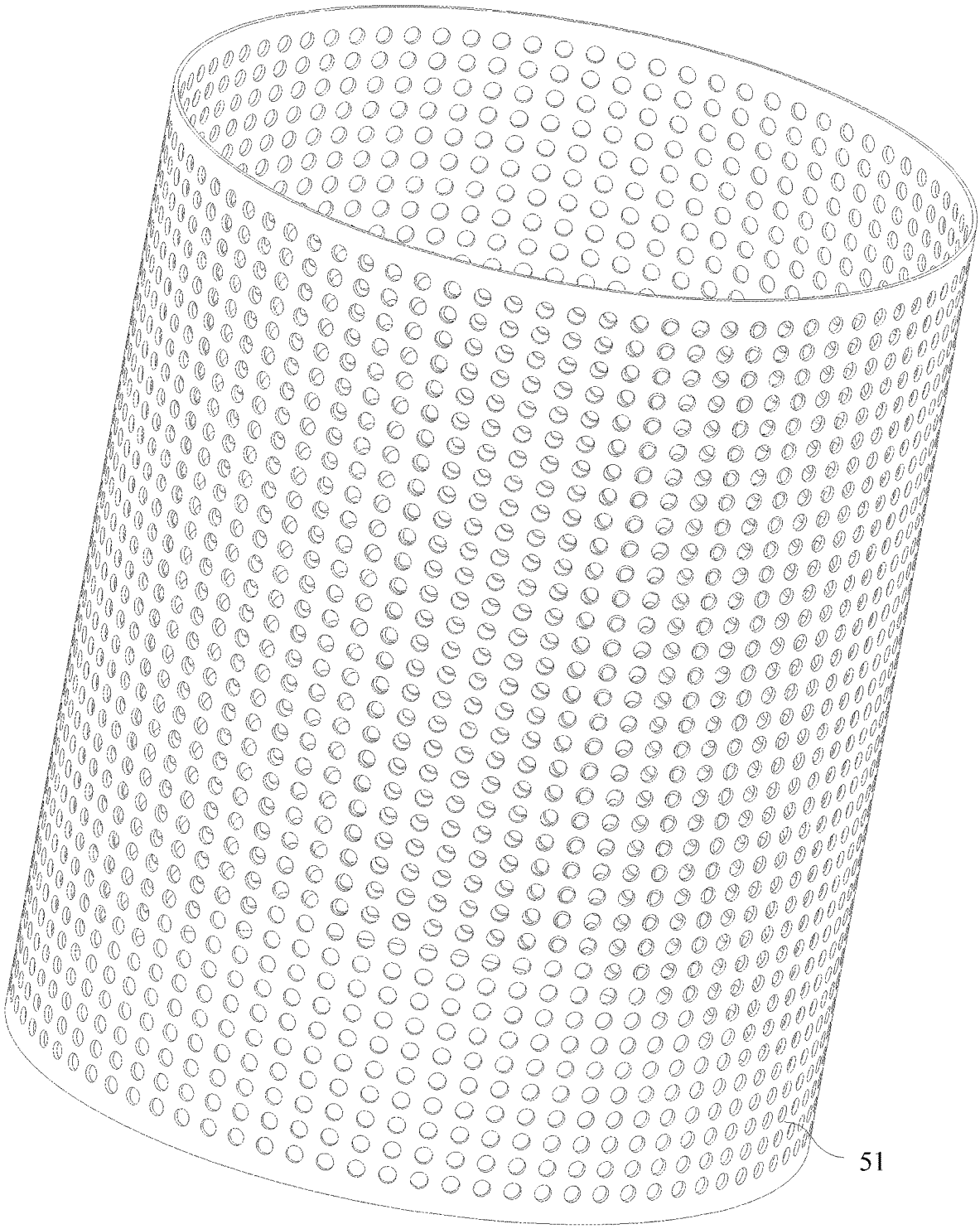
FIG. 6 is a schematic structural diagram of a first filter sleeve of the hair dryer according to the present disclosure.

Further, referring to FIG. 6, the hair dryer 100 further includes a first filter sleeve 50 sleeved and fixed on the handle 12, and configured to cover the air inlet 121. The first filter sleeve 50 includes first filter holes 51 for filtering the external air fluid. The first filter sleeve 50 is provided to filter the external fluid, thereby ensuring the cleanliness of the fluid flowing into the handle 12, and avoiding that foreign matter flows into the handle 12 to damage the hair dryer 100, thereby ensuring the use of the hair dryer 100.

Further, an end of the handle 12 away from the body 11 is protruded with abutting protrusions 122. When the first filter sleeve 50 is sleeved on the handle 12, the abutting protrusions 122 are configured to limit the first filter sleeve 50. The abutting protrusions 122 may be symmetrically disposed on an end of the handle 12 away from the body 11. Therefore, when the first filter sleeve 50 is sleeved behind the handle 12, the abutting protrusions 122 can abut and fix the first filter sleeve 50, and the force balance during abutment is ensured, so that the first filter sleeve 50 is not easy to shake after installation, and the installation stability of the first filter sleeve 50 is improved.

Figure 7:
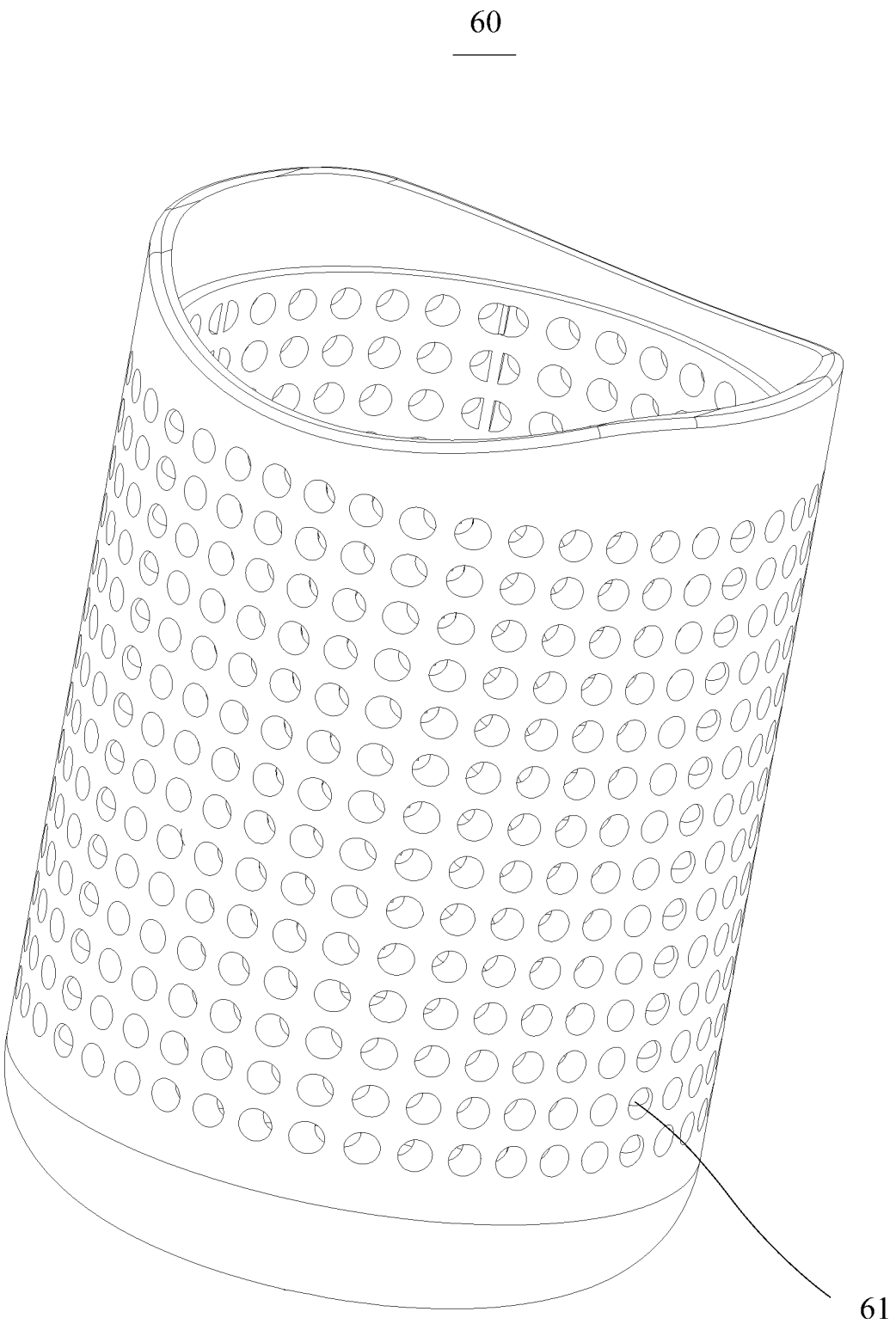
FIG. 7 is a schematic structural diagram of a second filter sleeve of the hair dryer according to the present disclosure.

In an embodiment of the present disclosure, referring to FIG. 2 and FIG. 7, the hair dryer 100 further includes a second filter sleeve 60 including second filter holes 61, and the second filter sleeve 60 is connected to the end of the handle 12 away from the body 11. An inner surface of the second filter sleeve 60 is abutted against an outer surface of the first filter sleeve 50, and the second filter hole 61 and the first filter hole 51 are oppositely disposed, a pore diameter of one of the first filter holes 51 is smaller than a pore diameter of one of the second filter holes 61. Specially, by providing the second filter sleeve 60 to cooperate with the first filter sleeve 50 to form a multi-layer filter, the effect of filtering the air fluid is further improved. The second filter sleeve 60 may be connected to the handle 12 by means of screws or buckles, etc. When the second filter sleeve 60 is connected to the handle 12, since the inner surface of the second filter sleeve 60 is abutted against the outer surface of the first filter sleeve 50, the first filter sleeve 50 can be simultaneously fixed through fixing the second filter sleeve 60, so that the first filter sleeve 50 and the second filter sleeve 60 can be fixed at the same time, thereby ensuring the stability of the overall structure of the hair dryer 100.

The present disclosure further provides a hair dryer 100. Referring to FIG. 1 to FIG. 5, the hair dryer 100 includes a housing 10 including a body 11 and a handle 12, and the body 11 being provided with a main control board (not shown); a power line 20 connected to the handle 12 and extending out of the handle 12; a conductive metal sheet 30 fixed to an inner wall of the handle 12, and configured to electrically conduct the main control board and the power line 20; and a fan (not shown) disposed in the handle 12 and electrically connected to the main control board, and a central axis of the fan coinciding with a central axis of the handle 12 in an extending direction of the handle 12.

Specially, in the extending direction of the handle 12, that is, the extending direction of the length of the handle 12, and the conductive metal sheet 30 is provided instead of a plurality of cables to achieve electrical conduction, thereby saving the wiring space in the handle 12, reducing the size of the hair dryer 100, and improving the user's feeling when holding the handle 12 of the hair dryer 100. The coincidence of the central axis of the fan with the central axis of the handle 12 can not only further reduce the size of the handle 12, but also in the process of using the hair dryer, when the fan speed exceeds 50,000 rpm, if the fan is not concentric with the handle 12, centrifugal force will be generated. Therefore, when the user uses the hair dryer, the user needs to apply more force to overcome the centrifugal force of the motor. The central axis of the fan coincides with the central axis of the handle 1212, so the centrifugal force generated by the fan at high speed can be reduced to reduce the force required for the user to hold the hair dryer, which further optimizes the user's feel when holding the handle 12.

The above are only preferred embodiments of the present disclosure, and thus do not limit the scope of the present disclosure. Any equivalent structure or equivalent process transformation made by using the description and drawings of the present disclosure is included in the scope of the present disclosure.

What is claimed is:

1. A hair dryer, comprising:

a housing provided with a main control board;

a power line connected to the housing and extending out of the housing; and a conductive metal sheet fixed to an inner wall of the housing, and configured to electrically conduct the main control board and the power line;

wherein the housing comprises a body and a handle connected to the body, and the conductive metal sheet is fixed to an inner wall of the handle.

2. The hair dryer of claim 1, wherein:

the power line comprises a live wire terminal and a neutral wire terminal; and the hair dryer comprises:

a first conductive metal sheet connected to the live wire terminal; and a second conductive metal sheet connected to the neutral wire terminal, the first conductive metal sheet and the second conductive metal sheet being symmetrically disposed on the inner wall of the housing.

3. The hair dryer of claim 1, wherein:

the conductive metal sheet is integrated with the inner wall of the housing; and/or the conductive metal sheet is a copper sheet.

4. The hair dryer of claim 1, wherein an anti-oxidation layer is formed on a portion of the conductive metal sheet exposed outside the inner wall of the housing.

5. The hair dryer of claim 1, wherein:

the main control board is disposed in the body; and the power line is connected to an end of the handle away from the body.

6. The hair dryer of claim 5, wherein the hair dryer further comprises an operation switch slidably disposed on the handle and located between the body and the conductive metal sheet, the operation switch being configured to make the main control board and the conductive metal sheet in a conducting state or a non-conducting state by sliding.

7. The hair dryer of claim 5, wherein:

the handle comprises an air inlet;

the body comprises an air outlet; and the hair dryer further comprises a fan located in the handle and electrically connected to the main control board, the fan being configured to suck an external air fluid from the air inlet.

8. The hair dryer of claim 7, wherein the hair dryer further comprises:

a first filter sleeve sleeved and fixed on the handle, and configured to cover the air inlet, the first filter sleeve comprising first filter holes for filtering the external air fluid.

9. The hair dryer of claim 8, wherein:

an end of the handle away from the body is protruded with abutting protrusions, the abutting protrusions being configured to limit the first filter sleeve when the first filter sleeve is sleeved on the handle; and/or the hair dryer further comprises a second filter sleeve connected to the end of the handle away from the body, an inner surface of the second filter sleeve being abutted against an outer surface of the first filter sleeve, the second filter sleeve comprising second filter holes oppositely disposed to the first filter holes, and a pore diameter of one of the first filter holes is smaller than a pore diameter of one of the second filter holes.

10. A hair dryer, comprising:

a housing comprising a body and a handle, the body being provided with a main control board;

a power line connected to the handle and extending out of the handle;

a conductive metal sheet fixed to an inner wall of the handle, and configured to electrically conduct the main control board and the power line; and a fan disposed in the handle and electrically connected to the main control board, and a central axis of the fan coinciding with a central axis of the handle in an extending direction of the handle.

* * * * *